US008991675B2

(12) United States Patent
Liang et al.

(10) Patent No.: US 8,991,675 B2
(45) Date of Patent: Mar. 31, 2015

(54) DYNAMIC CLUTCH APPARATUS FOR ELECTRICAL NAIL GUN

(75) Inventors: Chia-Sheng Liang, Taipei Hsien (TW); Chu-Hsiang Tseng, Taipei Hsien (TW)

(73) Assignee: De Poan Pneumatic Corp., Taipei Hsien (TW)

( * ) Notice: Subject to any disclaimer, the term of this patent is extended or adjusted under 35 U.S.C. 154(b) by 702 days.

(21) Appl. No.: 13/330,661

(22) Filed: Dec. 19, 2011

(65) Prior Publication Data

US 2013/0153254 A1 Jun. 20, 2013

(51) Int. Cl.
*B25D 11/00* (2006.01)
*B25C 1/06* (2006.01)

(52) U.S. Cl.
CPC .. *B25D 11/00* (2013.01); *B25C 1/06* (2013.01)
USPC ..... 227/131; 227/129

(58) Field of Classification Search
CPC ..... B25C 1/06; B25C 1/10; B25C 5/10; F16D 27/02; F16D 27/04; F16D 27/09; F16D 27/10; F16D 27/102; F16D 27/118; F16D 13/02; F16D 13/04; F16D 13/06; B25D 11/00
USPC ..... 227/120, 131–134; 192/48.1, 48.2, 192/48.3; 173/114
See application file for complete search history.

(56) References Cited

U.S. PATENT DOCUMENTS

| | | | | |
|---|---|---|---|---|
| 4,746,046 | A * | 5/1988 | Frye | 227/120 |
| 4,747,455 | A * | 5/1988 | Cunningham | 173/1 |
| 5,069,379 | A * | 12/1991 | Kerrigan | 227/131 |
| 5,098,004 | A | 3/1992 | Kerrigan | |
| 6,607,111 | B2 | 8/2003 | Garvis et al. | |
| 6,669,072 | B2 * | 12/2003 | Burke et al. | 227/131 |
| 6,974,061 | B2 | 12/2005 | Adams et al. | |
| 7,322,506 | B2 | 1/2008 | Forster | |
| 7,506,788 | B2 | 3/2009 | Liang et al. | |
| 7,575,141 | B1 | 8/2009 | Liang et al. | |
| 7,575,142 | B2 * | 8/2009 | Liang et al. | 227/133 |
| 8,157,144 | B2 * | 4/2012 | Andersson et al. | 227/131 |
| 8,348,119 | B2 * | 1/2013 | Fukinuki et al. | 227/131 |
| 2009/0095787 | A1 * | 4/2009 | Liang et al. | 227/131 |
| 2009/0294505 | A1 * | 12/2009 | Kunz et al. | 227/8 |

FOREIGN PATENT DOCUMENTS

| | | | |
|---|---|---|---|
| EP | 1582301 | A2 | 5/2005 |
| EP | 1582303 | A2 | 5/2005 |
| EP | 15802304 | A2 | 5/2005 |
| EP | 15802305 | A2 | 5/2005 |
| EP | 15802307 | A2 | 5/2005 |
| EP | 1584418 | A1 | 12/2005 |
| EP | 1584419 | A1 | 12/2005 |

* cited by examiner

*Primary Examiner* — Thanh Truong
*Assistant Examiner* — Joshua Kotis
(74) *Attorney, Agent, or Firm* — Chun-Ming Shih

(57) ABSTRACT

A dynamic clutch apparatus for an electrical nail gun includes a pair of symmetric direct stroke apertures formed on a gun body support; a firing pin set slidably installed on a side of the gun body support; a guiding base movably installed inside the gun body support; a pair of symmetric oblique stroke apertures formed on the guiding base. Aperture walls of the oblique and direct stroke apertures encircle and form an interconnected through aperture. Two pivot bearings are slidably installed inside the through aperture. A flywheel for accumulating kinetic energy is installed between the pivot bearings coaxially. An electromagnetic driver drives the guiding base to move, causing the through aperture to restrict the pivot bearings and the flywheel to move and press the firing pin set. Then, the firing pin set passes nail-percussion kinetic energy along a nail-percussion axial direction.

10 Claims, 6 Drawing Sheets

DYNAMIC CLUTCH APPARATUS FOR ELECTRICAL NAIL GUN

BACKGROUND

1. Technical Field

The invention relates generally to an electrical nail gun, and more particularly, to a dynamic clutch apparatus that uses a flywheel to drive a firing pin set.

2. Related Art

An electrical nail gun is an electrical hand tool that uses electricity to drive a firing pin set to generate nail-percussion kinetic energy. The firing pin set must be capable of outputting tremendous liner nail-percussion kinetic energy instantaneously. Patents such as U.S. Pat. No. 5,098,004, EP1584418, EP1584419 have already disclosed electrical nail guns that use flywheels to drive firing pin sets so as to generate nail-percussion kinetic energy.

A person skilled in the relevant art knows how to make use of the characteristic that when a flywheel is driven to rotate, the flywheel can accumulate rotational kinetic energy. The person can place the firing pin set between the flywheel and a free roller (a.k.a. a pinch roller) that can move. A swinging arm mechanism can serve as a dynamic clutch apparatus, controlling the free roller to move by rotation and oscillation. The free roller than presses the firing pin set, causing the firing pin set to touch and press the flywheel. At the moment when the firing pin set touches and presses the flywheel, the flywheel passes the accumulated rotational kinetic energy to the firing pin set, causing the firing pin set to instantaneously output tremendous liner nail-percussion kinetic energy, successfully firing nail components one by one.

In addition, the U.S. Pat. No. 7,575,141 discloses an electrical nail gun unlike those disclosed by the aforementioned patents. Specifically, the U.S. Pat. No. 7,575,141 gives the free roller a fixed position, and the free roller only serves for guidance and support purposes when the firing pin set is having liner nail-percussion movement. The patent further uses a different swinging arm mechanism to serve as a dynamic clutch apparatus, controlling the rotating flywheel to move, and as a result to touch the firing pin set and to press the firing pin set to move to percuss a nail.

It deserves mentioning that the U.S. Pat. No. 7,575,141 prevents the free roller from deviating from the nail-percussion axial direction when it presses and touches the flywheel, which is a common problem of the U.S. Pat. No. 5,098,004, EP1584418, and EP1584419 patents. This problem is severe especially when a skid base of the firing pin set has worn out after multiple frictions. However, in the patents, including the U.S. Pat. No. 7,575,141, the swinging arm mechanism serves as a dynamic clutch apparatus. When the firing pin set is being pressed by the free roller and the flywheel on two sides to pass kinetic energy, the swinging arm and the gun body support inevitably suffer from tremendous bending moment applied by the free roller or the flywheel. The bending moment is a bending load of the swinging arm; the swinging arm mechanism and the gun body support must be thick and strong enough to cope with the bending load. As a result, the swinging arm mechanism and the gun body support occupy too much volume of the gun body and add too much additional weight.

BRIEF SUMMARY

The invention provides a dynamic clutch apparatus for an electrical nail gun. It omits the swinging arm of the related art, hence resolves the aforementioned bending load problem suffered by the swinging arm and the gun body support when the flywheel is driving the firing pin set and applying bending moments on the swinging arm and the gun body support.

A dynamic clutch apparatus for an electrical nail gun according to the invention comprises a pair of symmetric direct stroke apertures, formed on a gun body support and extending along a first direction; a firing pin set, slidably installed on a side of the gun body support on the first direction along a nail-percussion axial direction, wherein the first direction is not parallel to the nail-percussion axial direction; a guiding base, movably installed inside the gun body support, driven by an electromagnetic driver to move along a second direction, wherein the second direction is not parallel to the first direction; a pair of symmetric oblique stroke apertures, formed on the guiding base and extending along a third direction, wherein the third direction is situated between the first direction and the second direction, and aperture walls of the oblique stroke apertures and the direct stroke apertures encircle and form an interconnected through aperture; and a flywheel for accumulating kinetic energy, wherein two sides of the flywheel have two pivot bearings installed coaxially, the pivot bearings are slidably installed inside the through aperture, when the guiding base moves along the second direction, the through aperture restricts the pivot bearings so as to cause the flywheel to move along the first direction synchronously, as a result driving the firing pin set to pass nail-percussion kinetic energy along the nail-percussion axial direction.

The firing pin set receives contacted-based guidance from a positioning pulley and is slidably installed on the nail-percussion axial direction, and the positioning pulley is pivoted on a side of the gun body support. The positioning pulley is located on the first direction, separated by the firing pin set and being adjacent to the direct stroke apertures. The second direction is perpendicular to the first direction and parallel to the nail-percussion axial direction, and the third direction and the second direction have an included angle of 15 to 30 degrees. A first elastic component is installed between the guiding base and the gun body support, driving the guiding base to move along the second direction and then to restore position. A second elastic component is installed inside the gun body support on a direction opposite to the first direction, protecting and supporting the guiding base. The electromagnetic driver is fixed on the gun body support so as to drive the guiding base. The flywheel rotates by being driven by an electrical motor, the electrical motor is positioned on the gun body support.

In the invention, an electromagnetic driver drives a guiding base to move along a second direction, causing a through aperture to move along a first direction and limiting a flywheel to move along the first direction synchronously. A firing pin set is installed on the first direction, so the flywheel can be driven to press and drive the firing pin set to move along a nail-percussion axial direction and percuss a nail component. This design does not involve a swinging arm, but instead uses direct stroke apertures to serve as a through aperture that restricts the flywheel's movement. When the flywheel drives the firing pin set, the outer walls of the pivot bearings have multiple contact-points with aperture walls of oblique stroke apertures and direct stroke apertures. As a result, load is shared. When the firing pin set is pressed by the positioning roller and the flywheel and kinetic energy is passed, the guiding base bears the pressure load and the gun body support bears the tension load. Therefore, the tremendous stress caused by bending load is effectively excluded.

Other features of the present invention will be apparent from the accompanying drawings and from the detailed description which follows.

BRIEF DESCRIPTION OF THE DRAWINGS

The invention is fully illustrated by the subsequent detailed description and the accompanying drawings, in which like references indicate similar elements.

DETAILED DESCRIPTION

The directions mentioned in this detailed description are vectors. The vectors help define directional characteristics such as relative positions of relevant components, movements, and forces. In the figures dotted arrows are used to represent directions.

Figure 1:
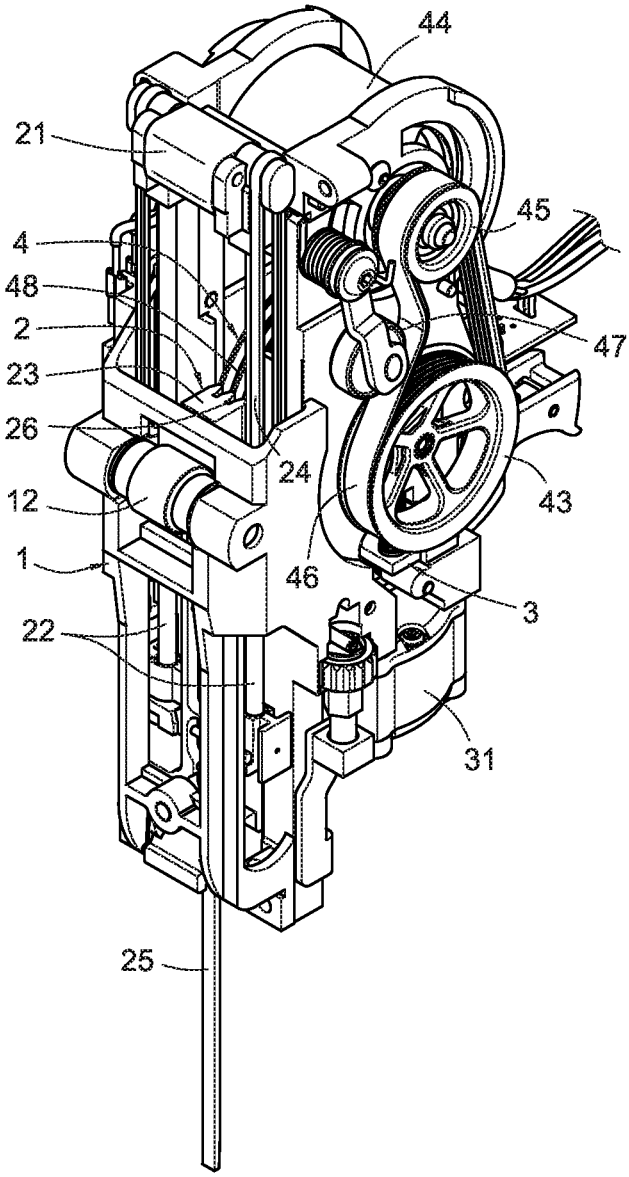
FIG. 1 shows a pictorial view of an embodiment of the invention.
Figure 2:
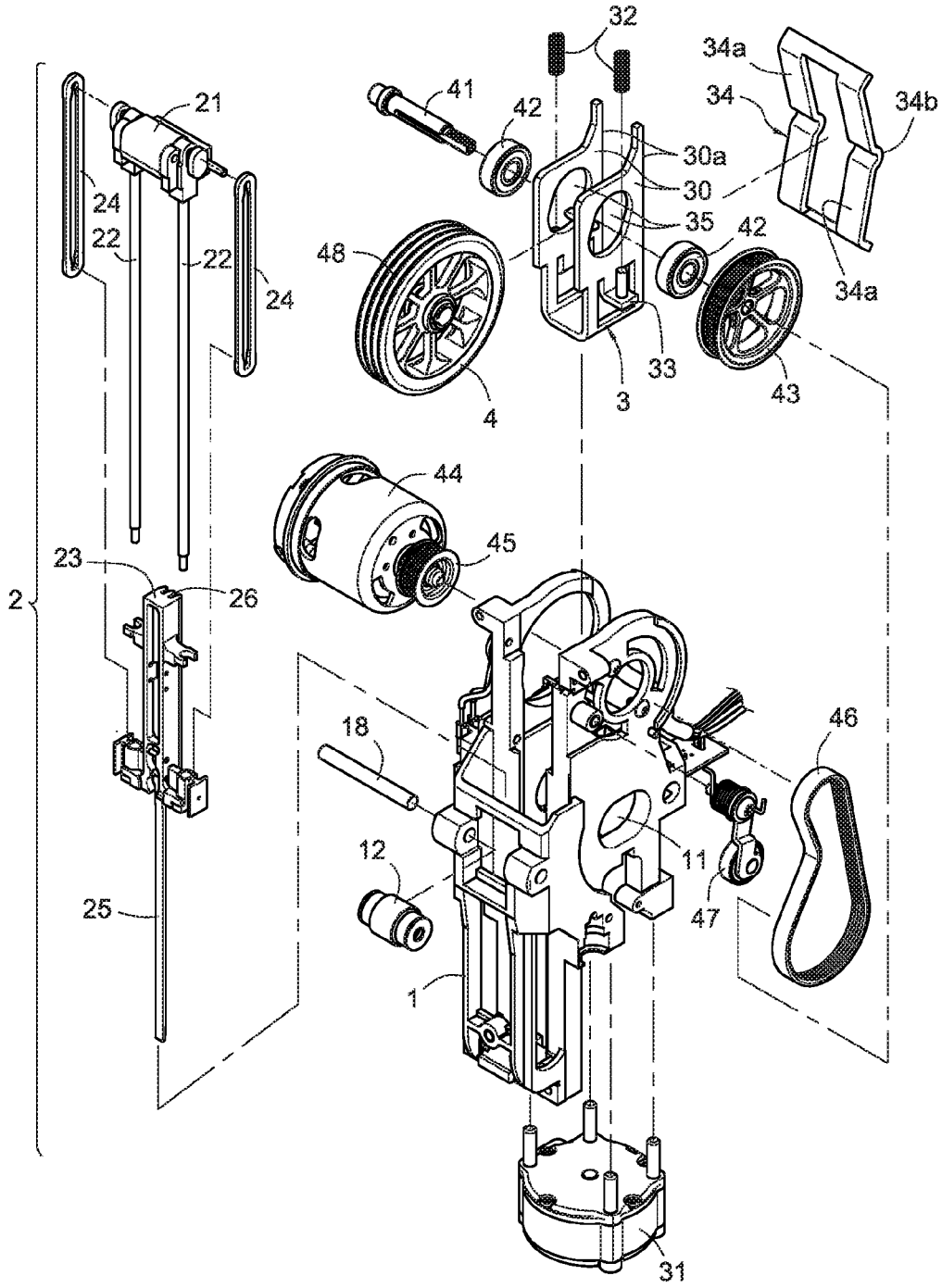
FIG. 2 shows an exploded pictorial view of the embodiment of FIG. 1.
Figure 3:
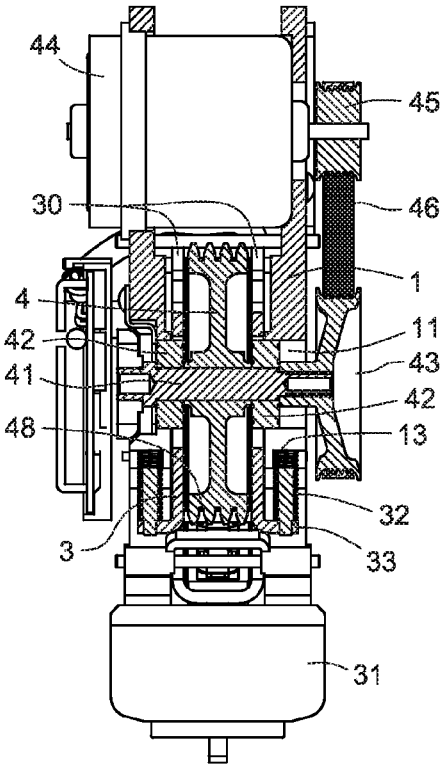
FIG. 3 shows a sectional view of the embodiment of FIG. 1.

Please refer to FIG. 1 to FIG. 3. FIG. 1 shows a pictorial view of a dynamic clutch apparatus for an electrical nail gun according to an embodiment of the invention. FIG. 2 shows an exploded pictorial view of the embodiment of FIG. 1. FIG. 3 shows a sectional view of the embodiment of FIG. 1. The dynamic clutch apparatus of this embodiment includes a gun body support 1, a firing pin set 2, a guiding base 3, and a flywheel 4.

The gun body support 1 is a fixed support for components such as the firing pin set 2, the guiding base 3, and the flywheel 4 to be installed thereon; hence the gun body support 1 can be viewed as a fixed end inside the gun body.

Figure 4:
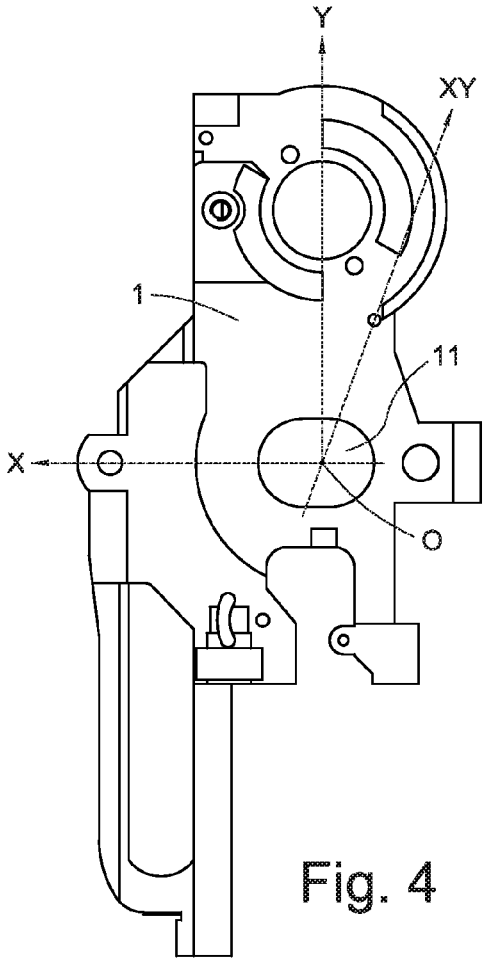
FIG. 4 shows a front view of the gun body support of FIG. 1.
Figure 5:
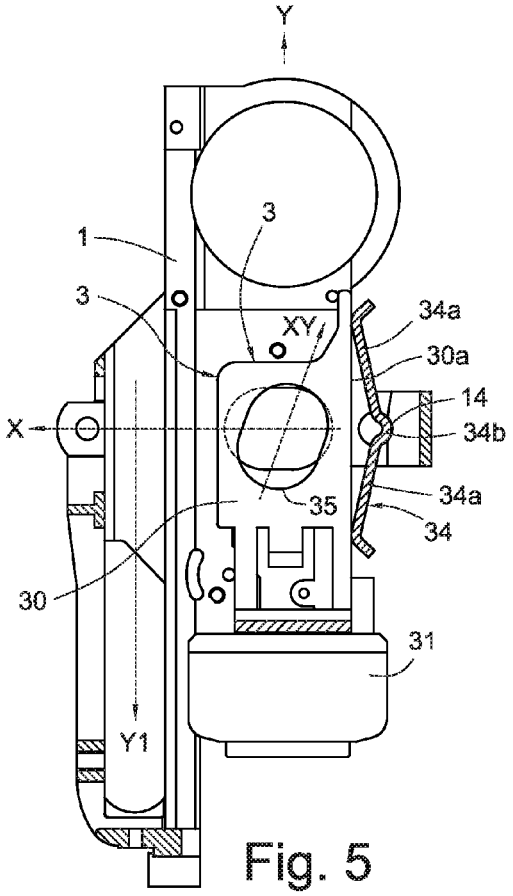
FIG. 5 shows a sectional view of the embodiment of FIG. 3, illustrating how a guiding base 3 and other relevant components are installed inside the gun body support.

FIG. 4 and FIG. 5 together illustrate a pair of symmetric direct stroke apertures 11 formed on the gun body support 1. On a coordinates system defined by coordinate axis X and coordinate axis Y, the direct stroke apertures 11 are formed on the gun body support 1 and extend along a first direction X.

Figure 6A:
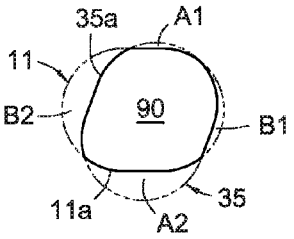
FIG. 6*a* illustrates the position of the through aperture in FIG. 6.
Figure 6:
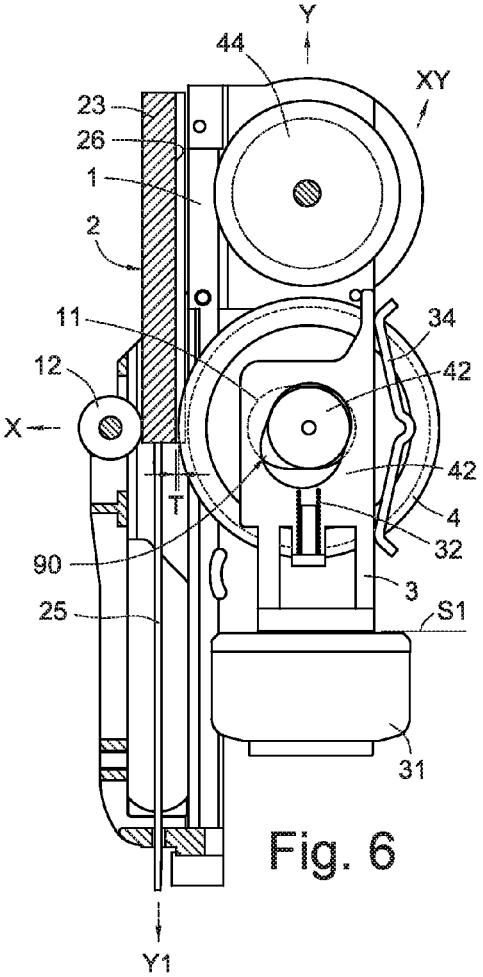
FIG. 6 shows a sectional view illustrating how kinetic energy causes the flywheel of FIG. 1 to depart from the firing pin set.

FIG. 5 and FIG. 6 together illustrate that the firing pin set 2 is located on the first direction X, and is slidably installed on a side of the gun body support 1 along a nail-percussion axial direction Y1. The first direction X is not parallel to the nail-percussion axial direction Y1. For example, the first direction X can be perpendicular to the nail-percussion axial direction Y1. More specifically, a pivot 18 is used to install a positioning pulley 12 pivotally on the gun body support 1. The firing pin set 2 is contacted by and guided by the positioning pulley 12 and slidably installed on the nail-percussion axial direction Y1. For example, the positioning pulley 12 is located on the first direction X, separated by the firing pin set 2 and being adjacent to the direct stroke apertures 11.

As shown in FIG. 2, the firing pin set 2 includes a fixed base 21, two guide pillars 22, a skid base 23, two elastic rings 24, and a firing pin 25. Please refer to both FIG. 1 and FIG. 6. The fixed base 21 is fixed on a side of the gun body support 1. The two guide pillars 22 are fixed parallel to a side of the fixed base 21. The skid base 23 is guided and held by the guide pillars 22 and is slidably installed on the nail-percussion axial direction Y1. On a surface of the skid base 23 adjacent to the flywheel 4, there are concave-convex embedding slots 26. The two elastic rings 24 encircle and lie between the skid base 23 and the fixed base 21, enabling the skid base 23 to load spring pressure and slide along the nail-percussion axial direction Y1 and then restore its original position. More specifically, the firing pin set 2 is contacted and guided by the positioning pulley 12 via the skid base 23, and is slidably installed on the nail-percussion axial direction Y1. The firing pin 25 is installed on the skid base 23 along the nail-percussion axial direction Y1, so as to allow the firing pin 25 to be slidably installed on the gun body support 1 along the nail-percussion axial direction Y1, and to percuss and release nail components inside the nail gun.

As shown in FIG. 3 and FIG. 5, the guiding base 3 is movably installed inside the gun body support 1 along a second direction Y. On the second direction Y inside the gun body support 1 there is an electromagnetic driver 31. The electromagnetic driver 31 can be an electromagnet, driven by a power of the electrical nail gun to output driving force via an axis component. The axis component of the electromagnetic driver 31 is connected to the guiding base 3 and hence can drive the guiding base 3 to move along the second direction Y.

Figure 5A:
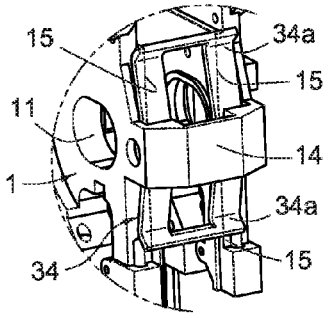
FIG. 5*a* shows a partial pictorial view of the embodiment of FIG. 5, illustrating how a second elastic component is installed in the gun body support.

As shown in FIG. 2, FIG. 3, and FIG. 5, the guiding base 3 has a pair of symmetric end walls 30. Between the guiding base 3 and the gun body support 1 there is a first elastic component 32 and a second elastic component 34. The first elastic component 32 can be a spiral spring. On two sides of the guiding base 3 and along the second direction Y there is a guiding-holding base 33 that can encircle an end of the first elastic component 32. The guiding-holding base 33 causes another end of the first elastic component 32 to tightly contact a positioning end 13 inside the gun body support 1. As a result, the electromagnetic driver 31 can drive the guiding base 3 to load spring pressure and move along a second direction Y when the electromagnetic driver 31 has been turned on. When the electromagnetic driver 31 has been turned off and has been demagnetized, the guiding base 3 can restore its original position. The second elastic component 34 is installed inside the gun body support on a direction opposite to the first direction by loading spring pressure, and can protect and hold the guiding base 3. For example, the second elastic component 34 can be an L-shaped flat spring, having two rod parts 34*a* on two sides and a baffle part 34*b* in the middle. The baffle part 34*b* contacts a positioning end 14 inside the gun body support 1. The rod parts 34*a* contact a positioning rib 15 (please refer to FIG. 5*a*), causing the second elastic component 34 to load spring pressure and stretch tightly between the positioning end 14 and the positioning rib 15 of the gun body support 1. In addition, the second elastic component 34 is located on a side 30*a* of the end walls 30 of the guiding base 3, so as to pre-store a restraining force on a direction −X opposite to the first direction X to protect and hold the guiding base 3.

As shown in FIG. 4, the second direction Y is not parallel to the first direction X. For example, the second direction Y can be perpendicular to the first direction X and has an intersection point O with the first direction X. As another example, the second direction Y can be parallel to the nail-percussion axial direction Y1.

As FIG. 2 and FIG. 5 indicate, two symmetric oblique stroke apertures 35 are formed on the end wall 30 of the guiding base 3. More specifically, as FIG. 4 and FIG. 5 indicate, the oblique stroke apertures 35 extend along a third direction XY, where the third direction XY lies between the first direction X and the second direction Y, and the three directions intersect on the aforementioned intersection point O. For example, the third direction XY and the second direction Y can have an included angle of 15 to 30 degrees. This causes the aperture walls of the oblique stroke apertures 35 and the direct stroke apertures 11 to surround and form an interconnected through aperture 90, which is shown in FIG. 6*a*. More specifically, as FIG. 6*b* indicates, the through aperture 90 is formed by being surrounded by the aperture wall 35*a* of the oblique stroke apertures 35 and the aperture wall 11*a* of the direct stroke apertures 11. This allows two pivot bearings 42, each has a proper circle outer wall contour, to be slidably installed inside the through aperture 90. The centers of the pivot bearings 42 happen to be located on the intersection point O. The pivot bearings 42 receive restriction, guidance, and support from the oblique stroke apertures 35 and the direct stroke apertures 11 to generate liner movement, which will be explained later.

As shown in FIG. 1 to FIG. 3, the wheel surface of the flywheel 4 has concave-convex wheel slots 48 that correspond to the embedding slots 26 of the skid base 23. The wheel center of the flywheel 4 has an axis component 41 that allows the pivot bearings 42 to be installed coaxially on two sides of the flywheel 4, so that the circular outer walls of the pivot bearings 42 can be slidably installed inside the through aperture 90. In addition, an end of the axis component 41 has a fixed driven belt wheel 43. An electrical motor 44 is fixed on the gun body support 1. An active belt wheel 45 is fixed on the axle center of the electrical motor 44. A belt 46 encircles both the active belt wheel 45 and the driven belt wheel 43 and is tightened by an elastic press roller 47 on the gun body support 1, so that the belt 46 can have a tension to avoid slipping. The belt 46 passes kinetic energy from the electrical motor 44 to the flywheel 4, allowing the electrical motor 44 to drive the flywheel 4 to rotate and accumulate rotational kinetic energy.

Figure 6B:
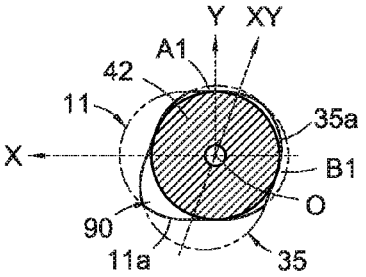
FIG. 6*b* illustrates the position of the pivot bearing in FIG. 6.

As FIG. 6 and FIG. 6*b* indicate, when no electricity is supplied to the electromagnetic driver 31, the guiding base 3 is tightened by the first elastic component 32 and slidably installed on a bottom position S1, causing the pivot bearings 42 to lie between the oblique aperture section A1 on the upper right side of the oblique stroke apertures 35 and the direct aperture section B1 on the right side of the direct stroke apertures 11. The rotating and kinetic-energy-accumulating flywheel 4's wheel slots 48 have a distance T apart from the embedding slots 26 of the skid base 23. Hence, the flywheel 4 rotates with no load and does not pass rotational kinetic energy to the skid base 23.

Figure 7:
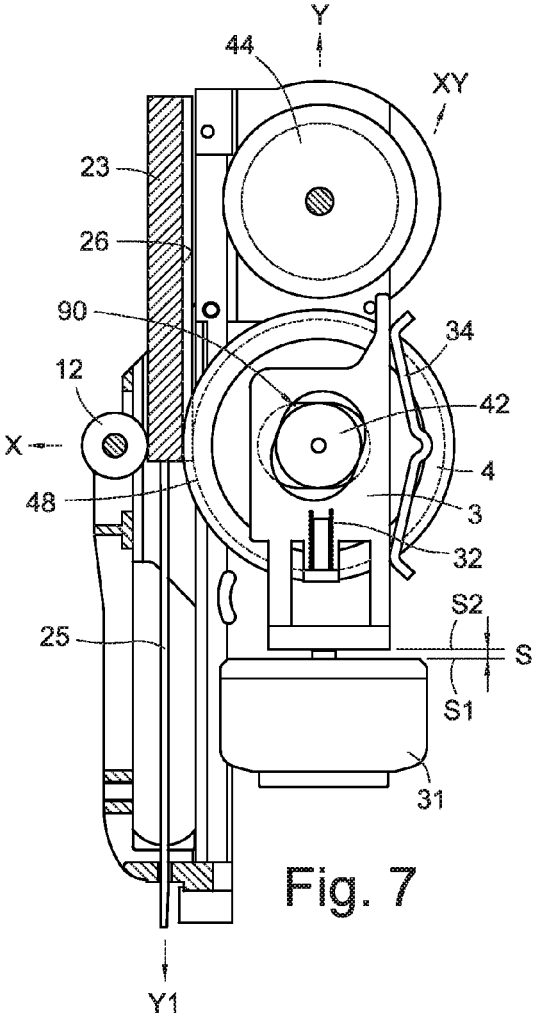
FIG. 7 shows a sectional view illustrating how the flywheel of FIG. 1 uses kinetic energy to drive the firing pin set.
Figure 7A:
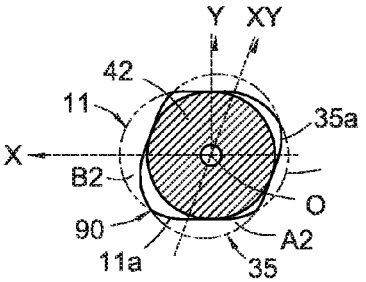
FIG. 7*a* illustrates the position of the pivot bearing in FIG. 7.
Figure 8:
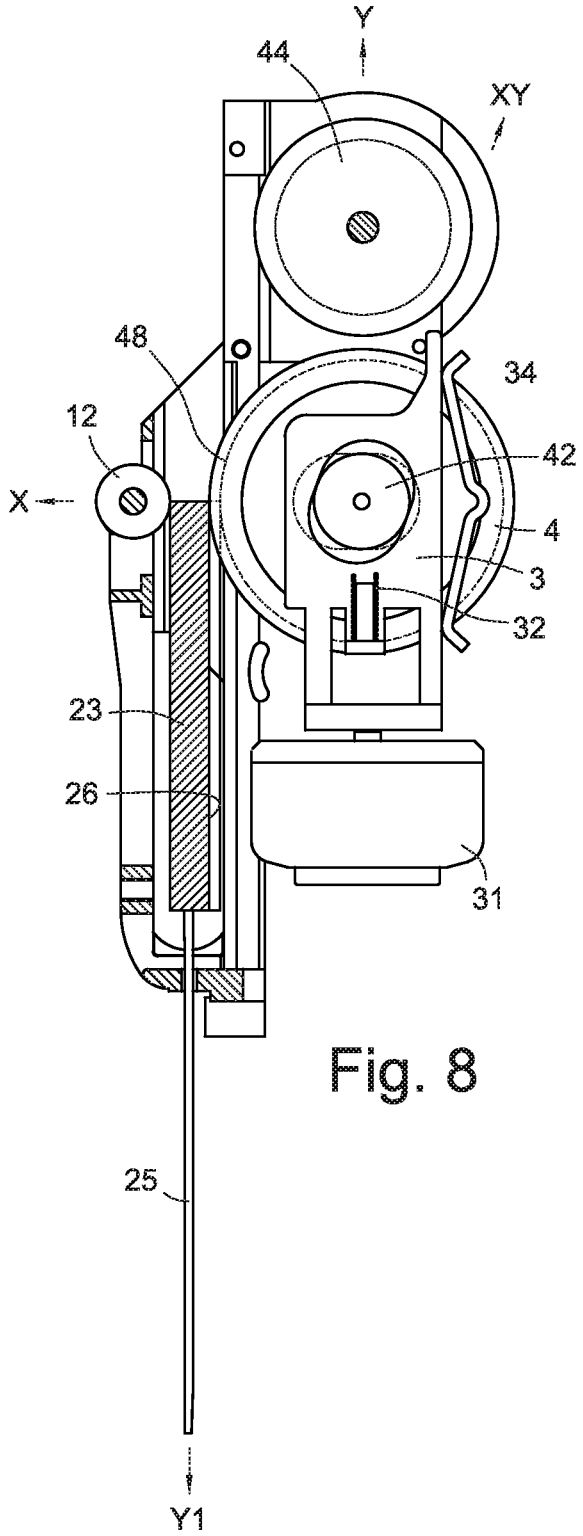
FIG. 8 shows a sectional view illustrating the position of the firing pin set after percussing a nail.

As FIG. 7 and FIG. 7*a* indicate, when a user turns on the power of the electrical nail gun and as a result causing the electromagnetic driver 31 to function, the guiding base 3 will load the elastic force of the first elastic component 32, and be driven by the axis component of the electromagnetic driver 31 to move along the second direction Y. As a result the guiding base 3 moves to a top position S2. A specific stroke S lies between the top position S2 and the bottom position S1. Because the pivot bearings 42 are restricted by the through aperture 90, the flywheel 4 moves along the first direction X. More specifically, the circular outer walls of the pivot bearings 42 have point contacts with the aperture walls 11*a* and 35*a* of the direct stroke apertures 11 and the oblique stroke apertures 35. The pivot bearings 42 are pushed when the aperture wall 35*a* of the oblique stroke apertures 35 is moving along the specific stroke S, and are restrained by the aperture wall 11*a* of the direct stroke apertures 11. As a result the pivot bearings 42 move towards the aperture section A2 on the lower left side of the oblique stroke apertures 35 and the aperture section B2 on the left side of the direct stroke apertures 11. As a result, the pivot bearings 42 and the flywheel 4 are driven to move along a first direction X, i.e. the skid base 23's direction. The wheel slots 48 of the rotating and kinetic-energy-accumulating flywheel 4 can engage with the embedding slots 26 of the skid base 23. In the meantime, the second elastic component 34 holds and protects the guiding base 3 on a direction −X opposite to the first direction X, preventing the guiding base 3 from having lateral movement along direction −X opposite to the first direction X when the flywheel 4 engages with the embedding slots 26. This is true even if the contact surface of the embedding slots 26 is not even. More specifically, the second elastic component 34 drives the flywheel 4 to more stably contact and press the skid base 23, so that the flywheel 4 can drive the skid base 23 to pass nail-percussion kinetic energy towards the nail-percussion axial direction Y1. As shown in FIG. 8, the result is that the firing pin 25 percusses a nail along the nail-percussion axial direction Y1. Afterward, the electromagnetic driver 31 is turned off and demagnetized, causing the guiding base 3 to be pushed by the first elastic component 32 and move back to the bottom position S1 as depicted in FIG. 6.

The aforementioned upper right, lower left, left, and right directions are based on the directions appear in the figures of the invention.

Based upon above, the embodiment uses the direct stroke apertures 11 to restrict the moving track of the flywheel 4. Furthermore, when the flywheel 4 drives the firing pin set 2, the embodiment uses the aperture walls 35*a* and 11*a* of the oblique stroke apertures 35 and the direct stroke apertures 11 to provide multiple contact points and as a result to share load and prolong the components' endurance and life. This also avoids the requirement of thick and strong swinging arms and gun body support, and as a result reduces the electrical nail gun's volume and weight. In addition, the embodiment further prevents the damages that might have been caused by bending loads.

In the foregoing detailed description, the invention has been described with reference to specific exemplary embodiments thereof. It will be evident that various modifications may be made thereto without departing from the spirit and scope of the invention as set forth in the following claims. The detailed description and drawings are, accordingly, to be regarded in an illustrative sense rather than a restrictive sense.

What is claimed is:

1. A dynamic clutch apparatus for an electrical nail gun, comprising:

a pair of symmetric direct stroke apertures, formed on a gun body support and each direct stroke aperture being elongated along a first direction;

a firing pin set, slidably installed on a side of the gun body support along a nail-percussion axial direction, wherein the first direction is not parallel to the nail-percussion axial direction;

a guiding base, movably installed inside the gun body support, driven by an electromagnetic driver to move along a second direction, wherein the second direction is not parallel to the first direction;

a pair of symmetric oblique stroke apertures, formed on the guiding base and each oblique stroke aperture being elongated along a third direction, wherein the third direction is situated between the first direction and the second direction, and aperture walls of the oblique stroke apertures and the direct stroke apertures encircle and form an interconnected through aperture; and a flywheel for accumulating kinetic energy, wherein two sides of the flywheel have two pivot bearings installed coaxially, the pivot bearings are slidably installed inside the through aperture, when the guiding base moves along the second direction, the through aperture restricts the pivot bearings so as to cause the flywheel to move along the first direction synchronously, as a result driving the firing pin set to pass nail-percussion kinetic energy along the nail-percussion axial direction.

2. The apparatus of claim 1, wherein the firing pin set receives contacted-based guidance from a positioning pulley, and the positioning pulley is pivoted on a side of the gun body support.

3. The apparatus of claim 2, wherein the positioning pulley is located on the first direction, separated by the firing pin set and being adjacent to the direct stroke apertures.

4. The apparatus of claim 1, wherein the second direction is perpendicular to the first direction.

5. The apparatus of claim 1, wherein the second direction is parallel to the nail-percussion axial direction.

6. The apparatus of claim 1, wherein the third direction and the second direction have an included angle of 15 to 30 degrees.

7. The apparatus of claim 1, wherein a first elastic component is installed between the guiding base and the gun body support, driving the guiding base to move along the second direction and then to restore position.

8. The apparatus of claim 1, wherein a second elastic component is installed inside the gun body support for protecting and supporting the guiding base.

9. The apparatus of claim 1, wherein the electromagnetic driver is fixed on the gun body support so as to drive the guiding base.

10. The apparatus of claim 1, wherein the flywheel rotates by being driven by an electrical motor, the electrical motor is positioned on the gun body support.

* * * * *